US008714379B2

(12) United States Patent
Grant

(10) Patent No.: US 8,714,379 B2
(45) Date of Patent: May 6, 2014

(54) CONTAINER CLOSURE HAVING A VACUUM RELEASER

(75) Inventor: Edward A. Grant, Northwood, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 3 days.

(21) Appl. No.: 13/471,715

(22) Filed: May 15, 2012

(65) Prior Publication Data

US 2013/0306586 A1 Nov. 21, 2013

(51) Int. Cl.
*B65D 51/16* (2006.01)
*B65D 55/00* (2006.01)

(52) U.S. Cl.
USPC ..... 215/262; 215/260; 215/270; 215/341; 215/349; 220/203.01; 220/203.04; 220/231; 220/366.1; 220/367.1

(58) Field of Classification Search
USPC ..... 215/262, 270–271, 253, 260, 316, 347, 215/349, 351; 220/203.01, 203.04, 203.08, 220/203.11–203.12, 203.15–203.16, 231, 220/270–271, 367.1, 202, 366.1, 368
See application file for complete search history.

(56) References Cited

U.S. PATENT DOCUMENTS

| | | | | |
|---|---|---|---|---|
| 51,785 | A | 1/1866 | Adams | |
| 1,470,488 | A | 10/1923 | Saunders et al. | |
| 1,700,958 | A * | 2/1929 | Staunton | 215/262 |
| 1,918,478 | A | 7/1933 | Laycock | |
| 1,944,355 | A | 1/1934 | MacKenzie | |
| 2,081,340 | A * | 5/1937 | Spahn | 215/262 |
| 2,092,192 | A * | 9/1937 | Von Till | 215/262 |
| 2,142,590 | A | 1/1939 | Smith | |
| 2,244,316 | A | 6/1941 | Robertson | |
| 2,326,809 | A * | 8/1943 | White | 215/336 |
| 3,163,310 | A * | 12/1964 | Blakslee | 215/305 |
| 3,227,302 | A | 1/1966 | Merrill | |
| 3,443,711 | A * | 5/1969 | Olson | 215/271 |
| 3,465,906 | A * | 9/1969 | Wagner et al. | 215/253 |
| 3,782,576 | A * | 1/1974 | Jacquemijns | 215/253 |
| 3,799,381 | A * | 3/1974 | Acton | 215/254 |
| 3,809,280 | A * | 5/1974 | Park et al. | 220/785 |
| 4,003,488 | A * | 1/1977 | Moller | 215/254 |
| 4,051,973 | A * | 10/1977 | Botkin | 215/260 |
| 4,122,964 | A * | 10/1978 | Morris | 215/260 |
| 4,398,491 | A * | 8/1983 | Fridl et al. | 116/67 R |
| 4,431,111 | A * | 2/1984 | Prohaska | 215/256 |

(Continued)

FOREIGN PATENT DOCUMENTS

DE 318116 1/1920

OTHER PUBLICATIONS

International Search Report and Written Opinion Mail Date: Jul. 11, 2013 Int. App. No. PCT/US2013/033033 Filed: Mar. 20, 2013.

*Primary Examiner* — Mickey Yu
*Assistant Examiner* — Brijesh V. Patel

(57) ABSTRACT

A closure including a shell having a base wall with an axial outer surface and an undersurface, an annular skirt around a periphery of the base wall, and circumferentially spaced securement elements extending radially inwardly from the skirt. A gasket is carried by the shell, and has a base surface in contact with the undersurface of the base wall of the shell and an oppositely disposed sealing surface. An elongated flexible member extends between the sealing surface of the gasket and the axial outer surface of the shell and around a portion of the skirt circumferentially between the securement elements.

28 Claims, 3 Drawing Sheets

(56) References Cited

U.S. PATENT DOCUMENTS 5,289,929 A * 3/1994 Heilman et al. ..... 215/230
5,833,090 A * 11/1998 Rojek ..... 215/262
5,954,214 A * 9/1999 Guezennec et al. ..... 215/262
6,196,408 B1 * 3/2001 Setty et al. ..... 220/276
7,147,228 B2 * 12/2006 Tonkin ..... 277/321
2011/0168660 A1 * 7/2011 Chmela ..... 215/251

* cited by examiner

CONTAINER CLOSURE HAVING A VACUUM RELEASER

The present disclosure is directed to closures for containers and, more particularly, to container closures applied to containers under vacuum.

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads to cooperate with corresponding features of the closure, and a circular end surface to cooperate with a seal on an undersurface of the closure. U.S. Pat. No. 2,244,316 illustrates a glass container and closure of this type.

A general object of the present disclosure, in accordance with one aspect of the disclosure, is to provide a closure having a feature that can be removed to release vacuum in a package that includes the closure sealingly applied to a container, wherein the closure can be resealed to the container after removal of the vacuum release feature.

The present disclosure embodies a number of aspects that can be implemented separately from or in combination with each other.

A package in accordance with one aspect of the disclosure includes a container having a neck finish with an open mouth surrounded by a container sealing surface, and a closure including a shell secured to the container over the open mouth to establish a package interior. The shell has a base wall and a skirt extending from the base wall. The package also includes a gasket on the shell having a base surface in contact with the base wall of the closure shell and an oppositely disposed gasket sealing surface in sealing engagement with the container sealing surface, product within the package under vacuum, and an elongated flexible member having one end extending out of the package interior, and another end extending into the package interior. The elongated flexible member also has a portion that extends along the package radially between the container neck finish and the closure shell skirt. Grasping and removal of the elongated flexible member opens a channel to vent the vacuum and facilitate removal of the closure from the container.

In accordance with another aspect of the disclosure, there is provided a closure that includes a shell having an axial outer surface, a base wall with an undersurface, an annular skirt around a periphery of the base wall, and circumferentially spaced securement elements extending radially inwardly from the skirt. The closure also includes a gasket carried by the shell, and having a base surface in contact with the undersurface of the base wall of the shell and an oppositely disposed sealing surface. The closure further includes an elongated flexible member extending between the sealing surface of the gasket and the axial outer surface of the shell and around a portion of the skirt circumferentially between the securement elements.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENT

Figure 1:
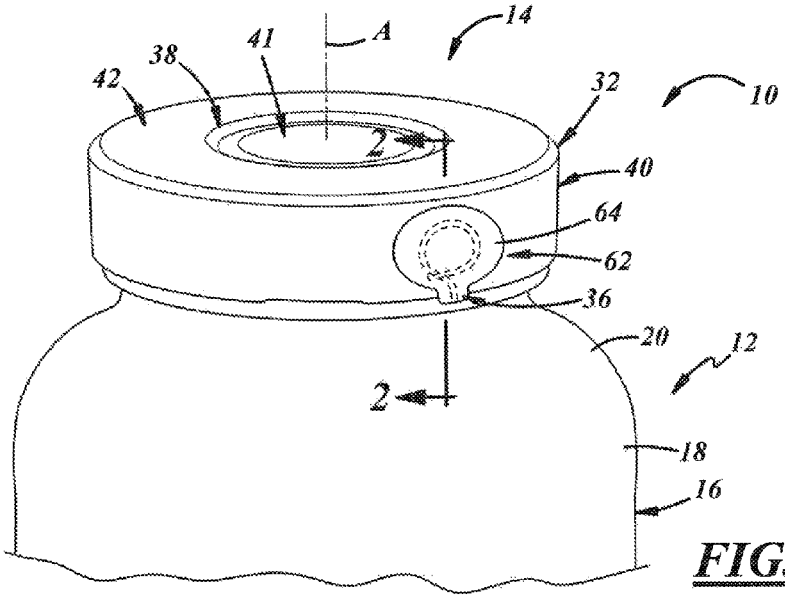
FIG. 1 is a fragmentary perspective view of a package including a container, and a closure in accordance with an illustrative embodiment of the present disclosure.

FIG. 1 illustrates a package 10 including a container 12, and a closure 14 that is coupled to the container 12. The package 10 may be used to package pickles, baby food, salsa, peppers, spaghetti sauces, jams, or any other hot-fill food product(s). The package 10 also may be used to package other types of products including but not limited to liquids, gels, powders, particles, and the like. The package 10 includes a longitudinal axis A, about which the closure 14 may be rotated with respect to the container 12.

The container 12 may be composed of glass, or any other material suitable for containing food products. The container 12 includes a body 16 including a base (not shown), and a sidewall 18 extending in a direction axially away from the base. The body 16 also may include a shoulder 20 extending from the sidewall 18. In other embodiments, however, the container body 16 need not include a shoulder, for instance, where the container 12 is a wide-mouth type of container.

Figure 2:
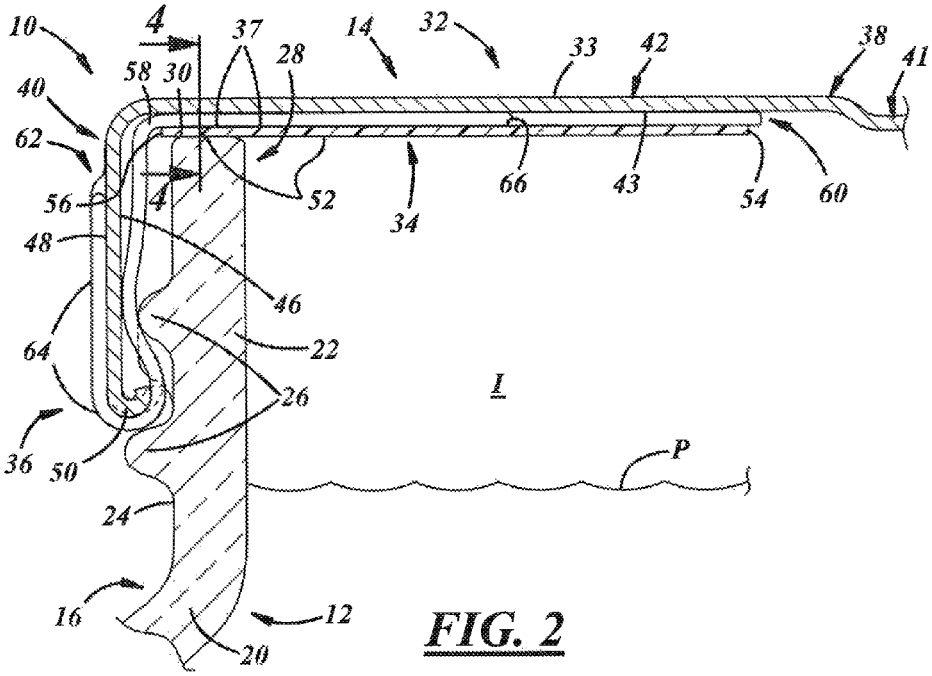
FIG. 2 is an enlarged fragmentary sectional view of the package of FIG. 1, taken along line 2-2 of FIG. 1.

Referring to FIG. 2, the container 12 also includes a neck finish 22 extending from the body 16. More particularly, the neck finish 22 may extend from the shoulder 20 of the body 16. In other embodiments, however, where the container body 16 does not include a shoulder, the neck finish 22 may extend directly from the sidewall 18 (FIG. 1). The neck finish 22 includes a radially outwardly facing surface 24 and one or more external, or radially outwardly extending, closure securement elements 26 that may include lugs, bayonets, thread segments, or any other suitable features, on the radially outwardly facing surface 24. As used herein, the phrase "thread segment" includes whole, partial, multiple, and/or an interrupted thread and/or thread segment. The closure securement elements 26 may include two, three, four, or any other suitable quantity of elements. In any case, the elements 26 collectively may extend completely circumferentially around the neck finish 22. The neck finish 22 includes an open mouth 28 surrounded by a sealing surface 30 of the neck finish 22. The sealing surface 30 faces axially for engagement with a corresponding portion of the closure 14. The container 12, with the closure 14 sealingly coupled thereto, establishes a package interior I and holds product P within the package 10, under vacuum.

Figure 3:
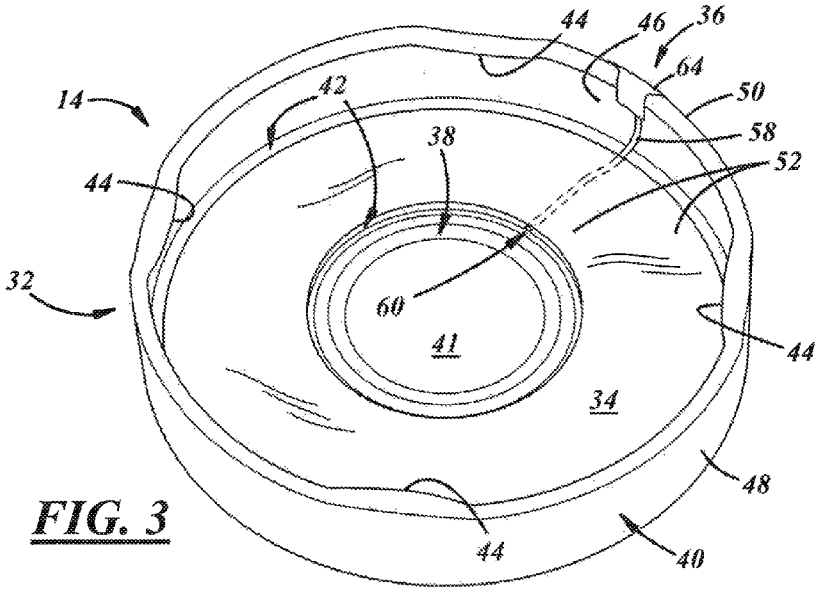
FIG. 3 is an enlarged perspective view of an underside of the closure of FIG. 1.

Referring to FIG. 3, the closure 14 may be composed of metal, plastic, and/or any other material(s) suitable for use with food products. The closure 14 may be provided in any suitable sizes, and may be a wide-mouth type of closure when the container 12 is a wide-mouth type of container. The closure 14 includes a shell 32, a gasket 34 carried by the shell 32, and a vacuum releaser 36 carried at least partially by the shell 32.

Referring to FIGS. 2 and 3, the shell 32 may include a base wall 38, and an annular skirt 40 extending away from the base wail 38 in a generally axial direction. The base wall 38 may include a radially central portion 41, and a radially outer portion 42 to carry the gasket 34 (FIG. 2) and disposed radially outwardly from the central portion 41. The central portion 41 may be disposed in a plane that is offset from a plane in which the outer portion 42 is disposed. The central portion 41 may be offset from the outer portion 42 in an axially inward direction, i.e., in the same direction in which the skirt 40 extends. The central portion 41 may be a flexible panel adapted to provide an audible sound upon release of vacuum within the package 10. The skirt 40 may be generally cylindrical and may extend in a generally axial direction from a radially outer periphery of the outer portion 42 of the base wall 38. The skirt 40 may include one or more internal, or radially inwardly extending, container securement elements 44 that are circumferentially spaced apart and are for engagement with the corresponding external closure securement elements 26 of the container 12. The skirt 40 also may include a radially inwardly facing surface 46, a radially outwardly facing surface 48, and an axial end 50.

Referring to FIGS. 2 and 3, the gasket 34 may include a sealing surface 52, and a base surface 37 (FIG. 2) disposed oppositely of the sealing surface 52 in an axial direction for coupling to the closure shell 32. For example, in general the base surface 37 may be adhered to the shell 32, molded to the shell 32, or coupled to the shell 32 in any other suitable manner. Also, in general, the sealing surface 52 may be planar, except where a portion of the vacuum releaser 36 passes between the sealing surface 52 of the gasket 34 and the closure shell 32, as will be described below. The gasket 34 may be annular and may extend between the central portion 41 and the skirt 40 of the shell 32 in a radial direction, and may at least partially cover the outer portion 42 of the shell base 38. The gasket 34 may be of sufficient radial dimension to engage the sealing surface 30 of the container 12 entirely around the sealing surface 30 to seal the package 10. The gasket 34 includes an inner diameter 54 and an outer diameter 56. The gasket 34 may be composed of a polyvinyl chloride material, for example, plastisol, or of any other suitable material.

Figure 4:
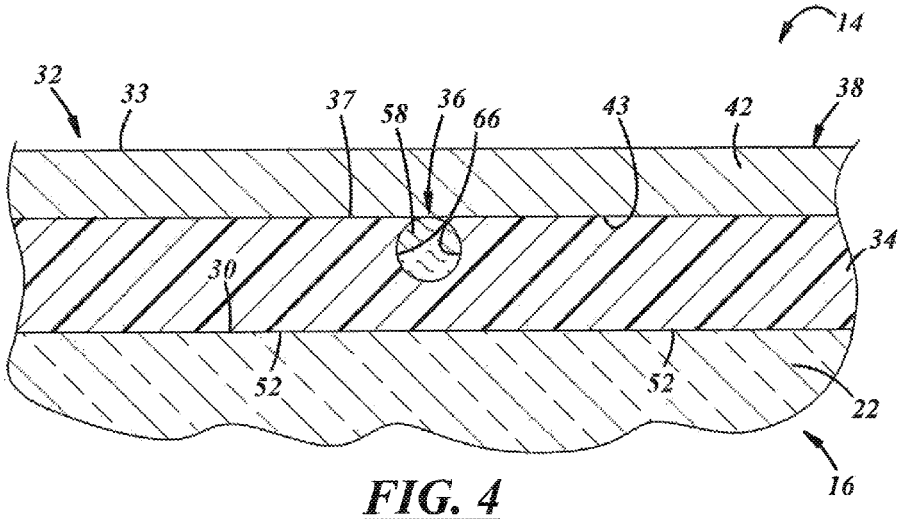
FIG. 4 is an enlarged cross-sectional view of a portion of the closure, taken along line 4-4 of FIG. 3.

Referring to FIGS. 2 and 4, the vacuum releaser 36 includes an elongated flexible member 58, at least a portion of which is disposed between the sealing surface 52 of the gasket 34 and an axial outer surface 33 of the closure shell base wall 38. More particularly, at least a portion of the elongated flexible member 58 may be disposed between the closure shell 32 and the gasket 34. More specifically, a portion of the elongated flexible member 58 may be disposed between an undersurface 43 of the base wall 38 of closure shell 32 and the gasket 34, for example, in contact with the undersurface 43 of the shell base wall 38 and in contact with the gasket 34. Accordingly, because the closure shell 32 is relatively rigid compared to the gasket 34, and depending on the thickness of the gasket 34 and the resiliency of the material of the gasket 34, the presence of the elongated flexible member 58 may produce a corresponding channel 66 in and open to the base surface 37 of the gasket 34. Accordingly, the elongated flexible member 58 is disposed in the channel 66. In another embodiment, the channel 66 may be preformed and the elongated flexible member 58 thereafter may be applied to the channel 66.

Referring to FIGS. 2 and 3, the elongated flexible member 58 may extend transversely along the closure 14. As used herein, the term "transverse" may mean disposed at some angle with respect to the longitudinal axis A of the closure 14 and may include but is not limited to a radial direction. Also as used herein, directional words such as top, bottom, upper, lower, radial, circumferential, lateral, longitudinal, transverse, vertical, horizontal, and the like are employed by way of description and not limitation. The elongated flexible member 58 includes a radially inner end 60 disposed radially inwardly with respect to the inner diameter 54 of the gasket 34, and a radially outer end 62 (FIG. 2) disposed radially outwardly with respect to the outer diameter 56 of the gasket 34. The inner end 60 may extend into the package interior I, and the outer end 62 may extend out of the package interior I. The elongated flexible member 58 may extend from the inner end 60 in a direction generally radially outwardly along the base wall 38 of the shell 32, through the outer diameter 56 of the gasket 34 toward the skirt 40 of the shell 32, along the radially inwardly facing surface 46 of the skirt 40, around the skirt 40 (e.g. around the axial end 50 of the skirt 40), and along the radially outwardly facing surface 48 of the skirt 40. In another embodiment, the elongated flexible member 58 need not extend through the outer diameter 56 of the gasket 34 and, instead, may protrude through the sealing surface 52 of the gasket 34 at a location that is radially inward of the outer diameter 56 but radially outward of the interface between the container 12 and the gasket 34.

As shown in FIG. 2, a portion of the flexible member 58 extends along the package 10 radially between the neck finish 22 of the container 12 and the skirt 40 of the closure 14. The flexible member 58 may be flaccid and may include a string, a ribbon, floss, or the like. The flexible member 58 may be composed of fiber, plastic, or any other suitable material(s) that may be approved by the U.S. Food and Drug Administration (FDA), and may be coated with wax, silicone, or any other suitable material(s) that may be approved by the FDA.

Referring to FIGS. 1 through 3, in one embodiment, the vacuum releaser 36 also may include a tab 64 at the outer end 62. For example, the tab 64 may include a sticker that may cover the outer end 62 of the flexible member 58, and is adhered to the radially outwardly facing surface 48 of the skirt 40 of the closure shell 32, and also may be adhered to the axial end 50 of the skirt 40 (FIG. 3). In another example, the tab 64 may include a handle that may be coupled to the outer end of the flexible member 58 for facilitating locating and grasping the flexible member 58. For example, the handle may be a loop at the end of the member 58 that may be adhered to or molded over the outer end of the flexible member 58. Although not shown, the tab 64 and/or a portion of the closure shell 32 may include indicia to indicate instructions for pulling the vacuum releaser 36 to release vacuum in the package 10.

In another embodiment, the vacuum releaser 36 need not include the tab 64. Accordingly, the outer end of the flexible member 58 simply may hang down, or may be adhered to the radially outwardly facing surface 48 of the skirt 40 or may be coupled thereto in any other suitable manner.

The package 10 may be produced in any suitable manner. In one embodiment, the flexible member 58 may be applied to the closure shell 32. For example, the flexible member 58 simply may be laid across the undersurface 43 of the base wall 38, or may have at least a portion thereof adhered to the undersurface 43 of the base wall 38. Also, the flexible member 58 may be laid over a corresponding portion of the skirt 40 and may be adhered thereto, for example, by a separate adhesive material or by a self-adhesive material that may be preapplied to the flexible member 58. Further, the tab 64 may be preapplied to a corresponding portion of the flexible member 58 and both may be applied to the skirt 40 with or without a separate adhesive. In any event, at least a portion of the flexible member 58 may be in contact with the base wall undersurface 43 of the closure shell 32. Thereafter, the gasket 34 may be applied to the closure shell 32 over the flexible member 58. For example, the gasket 34 may be a separate component that is adhered to the undersurface 43 of the base wall 38. In another example, the gasket 34 may be molded to the undersurface 43 of the base wall 38. Afterwards, the product P may be introduced into the container. Then, the closure 14 may be applied to the container 12. For example, the closure 14 may be placed and rotated over the open mouth 28 of the container 12 to interengage the securement elements 26, 44 and seal the package 10. The vacuum in the package 10 may be applied during the packaging process and/or may be created after packaging, for example, by product P shrinkage.

In another embodiment, the gasket 34 may be preformed to have the channel 66. Accordingly, a corresponding portion of the elongated flexible member 58 may be inserted into the channel 66, and then the gasket 34 and member 58 may be applied to the closure shell 32 by self-adhesion, a separate adhesive, or in any other suitable manner.

In use, and with reference to FIG. 2, grasping and removal of the elongated flexible member 58 opens the passage or channel 66 between the closure shell 32 and the gasket 34 to vent vacuum and facilitate removal of the closure 14 from the container 12. A user may grasp the vacuum releaser 36, and pull the vacuum releaser 36 in a generally radially outwardly direction such that the inner end 60 of the vacuum releaser 36 is pulled completely from a location radially inward of the radially inner diameter 54 of the gasket 34 to a location that is radially outward of the radially outer diameter 56 of the gasket 34. Accordingly, the passage or channel 66 between the gasket 34 and the base wall 38 of the closure shell 32 is opened, at least temporarily, by the absence of the flexible member 58, thereby establishing a vent path for air outside the package 10 to travel to the inside of the package 10 to vent the vacuum and facilitate removal of the closure 14 from the container 12.

Figure 5:
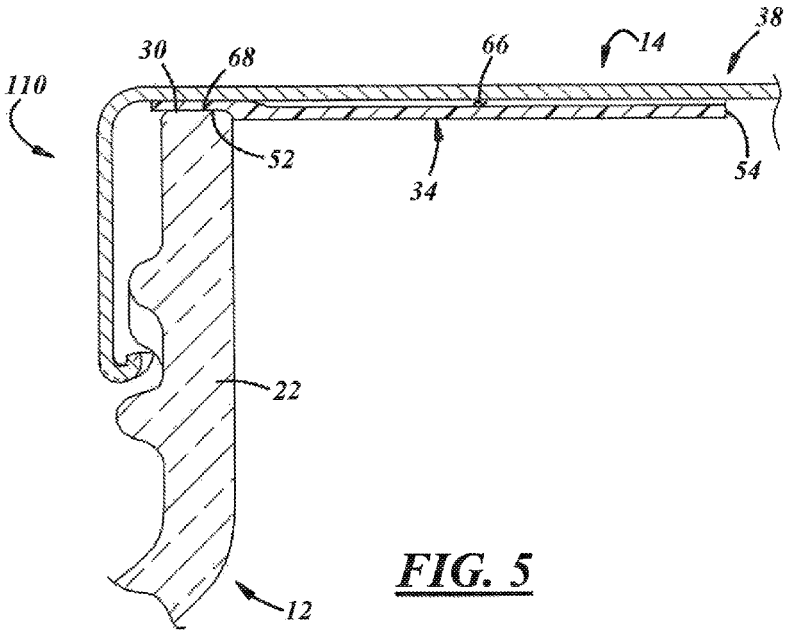
FIG. 5 is an enlarged fragmentary sectional view of a resealed package including the container of FIG. 1 and with the closure of FIG. 1 having a vacuum release portion thereof removed.

In fact, with reference to FIG. 5, the closure 14 may be reapplied to the container 12 in a resealable manner to establish a resealed package 110, without the vacuum releaser. In one embodiment, as the closure 14 is being fully coupled to the container 12, the sealing surface 30 of the container neck finish 22 contacts and flattens a corresponding portion 68 of the gasket 34 against the base wall 38 of the closure shell 32. This flattening cuts off the vent path channel 66 previously established by the removal of the flexible member. In another embodiment, the gasket material is self-sealing, wherein after removal of the flexible member 58 and consequent venting, the gasket material that was displaced by the flexible member 58 may engage the base wall 38 of the closure shell 32. Therefore, the vacuum releaser 36 may be manually removable from the closure 14 without damaging or otherwise compromising the integrity of the closure 14 or the container 12 wherein the closure 14 could not be resealed to the container 12.

Figure 6:
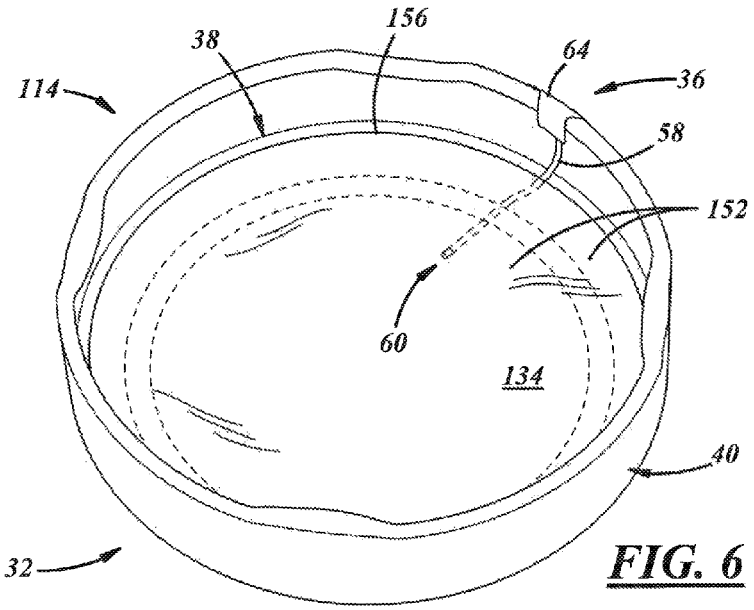
FIG. 6 is an enlarged perspective view of an underside of a closure in accordance with another illustrative embodiment.

FIG. 6 illustrates another illustrative embodiment of a closure 114. This embodiment is similar in many respects to the embodiment of FIGS. 1-5 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The closure 114 includes the shell 32, a gasket 134 carried the shell 32, and the vacuum releaser 36 carried at least partially by the shell 32. The shell 32 may include the base wall 38, and the annular skirt 40 extending away from the base wall 38 in a generally axial direction. The gasket 134 may include a sealing surface and an oppositely disposed base surface (not shown). The gasket 134 may be of circular disc configuration without an inner diameter, in contrast to the embodiment illustrated in FIG. 3. The vacuum releaser 36 includes the radially inner end 60 disposed in a location that is radially inward of a portion as indicated in phantom lines) of the gasket 134 that is engageable with the container 12, and the radially outer end (not shown) disposed radially outwardly with respect to an outer diameter 156 of the gasket 134. The inner end 60 may protrude through the sealing surface 152 of the gasket 134 so that the inner end 60 will extend into the interior of a package including the closure 114 coupled to the container 12. The elongated flexible member 58 may extend through the outer diameter 156 of the gasket 134 as shown, or may protrude through the sealing surface 52 of the gasket 34 at a location that is radially outward of the portion of the gasket 134 that is engageable with the container 12.

There thus has been disclosed a closure and a package that provide a vacuum release feature and fully satisfy one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A package that includes:

a container having a neck finish with an open mouth surrounded by a container sealing surface, a closure including a shell secured to the container over the open mouth to establish a package interior, said shell having a base wall and a skirt extending from the base wall, and also including a gasket on the shell having a base surface in contact with the base wall of the closure shell and an oppositely disposed gasket sealing surface in sealing engagement with the container sealing surface, a product within the package under vacuum, and an elongated flexible member extending between the closure shell and the sealing surface of the gasket and having one end extending out of the package interior, another end extending into the package interior, and a portion extending along the package radially between the container neck finish and the closure shell skirt, such that removal of the elongated flexible member opens a channel extending between the closure shell and the sealing surface of the gasket to vent the vacuum and facilitate removal of the closure from the container.

2. The package set forth in claim 1 wherein the container includes a radially outwardly facing surface around the open mouth with external securement elements around the radially outwardly facing surface, the closure includes the skirt with internal securement elements engaged with the external securement elements to hold the closure on the container, and the elongated flexible member extends between the skirt and the radially outwardly facing surface at a position circumferentially spaced between the securement elements of the closure.

3. The package set forth in claim 2 including a handle coupled to the elongated flexible member outside of the container to facilitate grasping and pulling of the elongated flexible member.

4. The package set forth in claim 2 including a sticker coupled to the elongated flexible member outside of the container and adhered to the closure skirt.

5. The package set forth in claim 1 wherein the closure includes the base wall including a radially central portion, and a radially outer portion disposed radially outwardly of the radially central portion and carrying the gasket, wherein the radially central portion is a flexible panel to provide an audible sound upon release of vacuum within the package.

6. The package set forth in claim 1 wherein the closure may be reapplied to the container in a resealable manner to establish a resealed package.

7. The package set forth in claim 6 wherein as the closure is reapplied and fully coupled to the container, the sealing surface of the container contacts and flattens a portion of the gasket against the closure shell to cut off the channel established by the removal of the elongated flexible member.

8. The package set forth in claim 1 wherein a portion of the elongated flexible member is disposed between a sealing surface of the gasket and an undersurface of the base wall of the closure shell.

9. A package that includes:

a container having a neck finish with an open mouth surrounded by a container sealing surface, a closure including a shell secured to the container over the open mouth to establish a package interior, said shell having a base wall and a skirt extending from the base wall, and also including a gasket on the shell having a base surface in contact with the base wall of the closure shell and an oppositely disposed gasket sealing surface in sealing engagement with the container sealing surface, a product within the package under vacuum, and an elongated flexible member having one end extending out of the package interior, another end extending into the package interior, and a portion extending along the package radially between the container neck finish and the closure shell skirt, such that removal of the elongated flexible member opens a channel to vent the vacuum and facilitate removal of the closure from the container, wherein the elongated flexible member has at least a portion between the ends in contact with the closure shell base wall and extending along the channel, which is open to the base surface of the gasket.

10. A package that includes:

a container having a neck finish with an open mouth surrounded by a container sealing surface, a closure including a shell secured to the container over the open mouth to establish a package interior, said shell having a base wall and a skirt extending from the base wall, and also including a gasket on the shell having a base surface in contact with the base wall of the closure shell and an oppositely disposed gasket sealing surface in sealing engagement with the container sealing surface, a product within the package under vacuum, and an elongated flexible member having one end extending out of the package interior, another end extending into the package interior, and a portion extending along the package radially between the container neck finish and the closure shell skirt, such that removal of the elongated flexible member opens a channel to vent the vacuum and facilitate removal of the closure from the container, wherein the closure includes the skirt having a radially inwardly facing surface, a radially outwardly facing surface, and an axial end between the facing surfaces, and the annular gasket includes an inner diameter and an outer diameter, and wherein the elongated flexible member includes the one end disposed radially outwardly with respect to the outer diameter of the annular gasket and the other end disposed radially inwardly with respect to the inner diameter of the gasket.

11. The package set forth in claim 10 wherein the elongated flexible member is displaceable in a radially outwardly direction such that the other end thereof is pulled completely from a location radially inward of the radially inner diameter of the gasket to a location that is radially outward of the radially outer diameter of the gasket to create the channel between the sealing surface of the gasket and the closure shell.

12. A closure that includes:

a shell having a base wall with an axial outer surface and an undersurface, an annular skirt around a periphery of the base wall, and circumferentially spaced securement elements extending radially inwardly from the skirt, a gasket carried by the shell, and having a base surface in contact with the undersurface of the base wall of the shell and an oppositely disposed sealing surface, and an elongated flexible member extending between the sealing surface of the gasket and the axial outer surface of the shell and around a portion of the skirt circumferentially between the securement elements.

13. The closure set forth in claim 12 wherein the skirt includes a radially inwardly facing surface, a radially outwardly facing surface, an axial end therebetween, and circumferentially spaced internal securement elements, and wherein the elongated flexible member extends around the axial end at a position circumferentially spaced between the internal securement elements.

14. The closure set forth in claim 12 including a handle coupled to the elongated flexible member to facilitate grasping and pulling of the elongated flexible member.

15. The closure set forth in claim 12 including a sticker coupled to the elongated flexible member and adhered to the closure skirt.

16. The closure set forth in claim 12 wherein the base wall includes a radially central portion, and a radially outer portion disposed radially outwardly of the radially central portion and carrying the gasket, wherein the radially central portion is a flexible panel to provide an audible sound upon release of vacuum within a package including the closure.

17. The closure set forth in claim 12 wherein the skirt has a radially inwardly facing surface, a radially outwardly facing surface, and an axial end between the facing surfaces, and the annular gasket includes an inner diameter and an outer diameter, and wherein the elongated flexible member includes the one end disposed radially outwardly with respect to the outer diameter of the annular gasket and the other end disposed radially inwardly with respect to the inner diameter of the gasket.

18. The closure set forth in claim 12 wherein the elongated flexible member is removable without compromising the integrity of the closure.

19. The closure set forth in claim 12 wherein the elongated flexible member has at least a portion in contact with the closure shell base wall and extends along a channel in and open to the base surface of the gasket.

20. The package set forth in claim 12 wherein said gasket is annular and has inner and outer diameters and the elongated flexible member extends to a location radially inward of the inner diameter.

21. The package set forth in claim 12 wherein said gasket is a circular disc and the elongated flexible member extends through a portion of said circular disc.

22. The closure set forth in claim 12 wherein a portion of the elongated flexible member is disposed between a sealing surface of the gasket and an undersurface of the base wall of the closure shell.

23. The closure set forth in claim 12 wherein the elongated flexible member is an element separate from the closure shell and the gasket.

24. The closure set forth in claim 23 wherein the elongated flexible member is a string.

25. A package including a container having a sealing surface, and the closure set forth in claim 12 applied to the container such that the sealing surface engages the gasket to seal the package.

26. The package set forth in claim 25 wherein the elongated flexible member extends between the closure shell and the sealing surface of the gasket, such that grasping and removal thereof opens a channel in and open to the base surface of the gasket to release vacuum and thereby facilitate removal of the closure.

27. The package set forth in claim 26 wherein the closure may be reapplied to the container in a resealable manner to establish a resealed package, wherein as the closure is fully coupled to the container, the sealing surface of the container contacts and flattens a portion of the gasket against the closure shell to cut off the channel established by the removal of the elongated flexible member.

28. The package set forth in claim 27, wherein the container includes a neck finish and a portion of the elongated flexible member extends along the package radially between the container neck finish and the closure shell skirt.

* * * * *